United States Patent [19]

Crosson et al.

[11] Patent Number: 4,690,658

[45] Date of Patent: Sep. 1, 1987

[54] TOY CAR LAUNCHER WITH EXPANDABLE SCISSORS MEMBERS

[75] Inventors: Peter Crosson, Torrance; Terry Sanchez, Lakewood; Kevin Gray, San Pedro; Samuel M. Goldstein, Los Angeles, all of Calif.

[73] Assignee: Mattel, Inc., Hawthorne, Calif.

[21] Appl. No.: 880,775

[22] Filed: Jul. 1, 1986

[51] Int. Cl.[4] ..... A63H 29/00

[52] U.S. Cl. ..... 446/429; 124/79; 273/129 T

[58] Field of Search ..... 446/429, 430, 63; 124/79, 10; 273/129 R, 129 L, 129 P, 129 S, 129 T, 324, 328

[56] References Cited

U.S. PATENT DOCUMENTS

| | | | |
|---|---|---|---|
| 2,921,792 | 1/1960 | Guss | 124/79 X |
| 3,548,534 | 12/1970 | Beny et al. . | |
| 3,600,850 | 8/1971 | Summerfield et al. . | |
| 3,641,704 | 2/1972 | Sims et al. . | |
| 3,797,164 | 3/1974 | Glass et al. . | |
| 3,952,442 | 4/1976 | Livesey et al. . | |
| 3,998,460 | 12/1976 | Dyer | 273/86 |
| 4,108,437 | 8/1978 | DeAnda et al. | 273/86 |
| 4,418,495 | 12/1983 | Kennedy et al. . | |
| 4,423,871 | 1/1984 | Mucaro | 273/86 |
| 4,433,504 | 2/1984 | Terui . | |
| 4,472,906 | 9/1984 | Cook et al. | 446/429 |
| 4,488,723 | 12/1984 | La Grow | 273/129 T |
| 4,504,242 | 3/1985 | Crain et al. | 446/429 |
| 4,513,967 | 4/1985 | Halford et al. | 273/108 |
| 4,533,142 | 8/1985 | Peters | 124/79 X |

*Primary Examiner*—Mickey Yu

*Attorney, Agent, or Firm*—Ronald M. Goldman; Melvin A. Klein; Daniel F. Sullivan

[57] ABSTRACT

A toy vehicle launcher having a hand grip which can be squeezed to move expandable scissors members forward in order to launch a toy vehicle. The scissors members form an expandable parallelogram linkage which is slidable mounted inside the launcher. When the hand grip is squeezed, a trigger member pivotably mounted to the grip moves a sliding plate mounted inside the launcher. As the sliding plate moves, two pins attached to the sliding plate operably engage elongated slots in two of the scissors members, pulling the two members backward and causing the linkage to expand forward. A launching plate supported on top of the scissors members moves forward with the expanding linkage pushing a toy vehicle forward. Since the linkage expands forward in a relatively smooth and uniform manner, the toy vehicle is also launched in a relatively uniform manner, helping to avoid activating or damaging any impact-activated mechanisms in the vehicle. A child may control the rate of acceleration of a vehicle being launched by controlling how hard the hand grip is squeezed.

6 Claims, 5 Drawing Figures

40
38
52
38
46
54
54
42
38
54
52
54
42

12
18
16
10
14
50
60
62
13
15
17

18
16
22
24
26
28
30
32
20
36
12
64
38
50
62
13
65
38
48
58
38
38
60
14
38
44
38
28

TOY CAR LAUNCHER WITH EXPANDABLE SCISSORS MEMBERS

BACKGROUND OF THE INVENTION

The present invention relates generally to toy car launchers and, more particularly, to a launcher having a hand grip which can be squeezed to move expandable scissors members forward for the purpose of launching a toy car.

Various types of launchers have been developed in the past which allow a child to propel or launch a toy car forward during play. For example, toy car launchers are disclosed in U.S. Pat. Nos. 4,513,967 issued to Halford et al on Apr. 30, 1985; 4,504,242 issued to Crain et al on Mar. 12, 1985; 4,472,906 issued to Cook et al on Sept. 25, 1984; 4,433,504 issued to Terui on Feb. 28, 1984; 4,423,871 issued to Mucaro on Jan. 3, 1984; 4,418,495 issued to Kennedy et al on Dec. 6, 1983; 4,108,437 issued to De Anda et al on Aug. 22, 1978; 3,952,442 issued to Livesey et al on Apr. 27, 1976; and 3,797,164 issued to Glass et al on Mar. 19, 1974. Belt-type mechanisms used to move a toy vehicle are described in U.S. Pat. Nos. 3,600,850 issued to Summerfield et al on Aug. 24, 1971 and 3,548,534 issued to Beny et al on Dec. 22, 1970. Finally, vehicle propulsion devices are disclosed in U.S. Pat. Nos. 3,998,460 issued to Dyer on Dec. 21, 1976 and 3,641,704 issued to Sims et al on Feb. 15, 1972.

A hand-operated toy car launcher which accelerates the car in a smooth and uniform manner would be particularly desirable because such a launcher could be used to avoid activating or damaging shock or impact-activated mechanisms in the car. None of the above patents discloses such a launcher. A launcher using an expandable parallelogram linkage with scissors members activated by a hand grip could be used to launch a toy car in a uniform manner. Toy guns using expandable linkage have been used in the past, but none of the above patents discloses the use of expandable linkage in a toy launcher. By using the expandable linkage, the rate of acceleration of a car being launched may be controlled by how hard a child squeezes the hand grip. Accordingly, there is a need in the toy manufacturing arts for a launcher having a hand grip which can be squeezed to move expandable scissors members forward in order to launch a toy car.

SUMMARY OF THE INVENTION

It is an object of this invention to provide an improved toy car launcher.

It is another object of this invention to provide an improved toy car launcher which accelerates the car in a smooth and uniform manner to avoid activating or damaging shock or impact-activated mechanisms in the car.

It is still another object of this invention to provide an improved toy car launcher having a hand grip which may be used to control the rate of acceleration of a launcher car.

These and other objects and advantages are attained by a toy vehicle launcher having a hand grip which can be squeezed to move expandable scissors members forward in order to launch a toy vehicle. The scissors members form an expandable parallelogram linkage which is slidably mounted inside the launcher. When the hand grip is squeezed, a trigger member pivotably mounted to the grip moves a sliding plate mounted inside the launcher. As the sliding plate moves, two pins attached to the sliding plate operably engage elongated slots in two of the scissors members, pulling the two members backward and causing the linkage to expand forward. A launching plate supported on top of the scissors members moves forward with the expanding linkage pushing a toy vechicle forward. Since the linkage expands forward in a relatively smooth and uniform manner, the toy vehicle is also launched in a relatively uniform manner, helping to avoid activating or damaging any impact-activated mechanisms in the vehicle. A child may control the rate of acceleration of a vehicle being launched by controlling how hard the hand grip is squeezed.

The various features of the present invention will be best understood, together with further objects and advantages by reference to the following description of the preferred embodiment taken in connection with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that various modifications can be accomplished within the parameters of the present invention.

Figure 1:
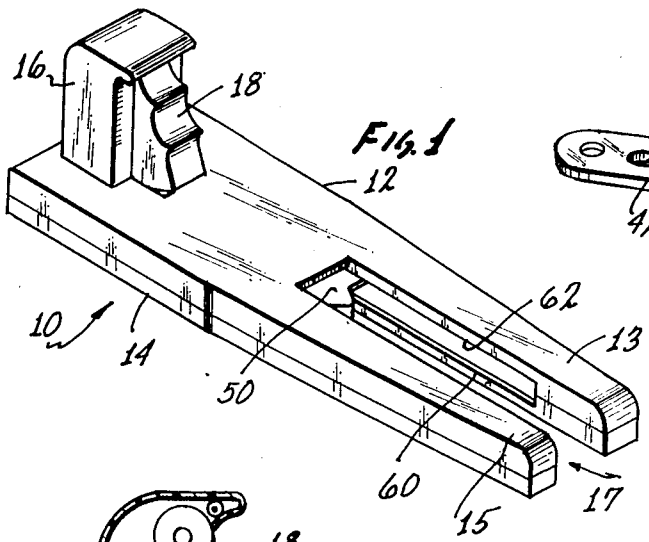
FIG. 1 is perspective view of the preferred embodiment of the toy car launcher of the present invention.
Figure 4:
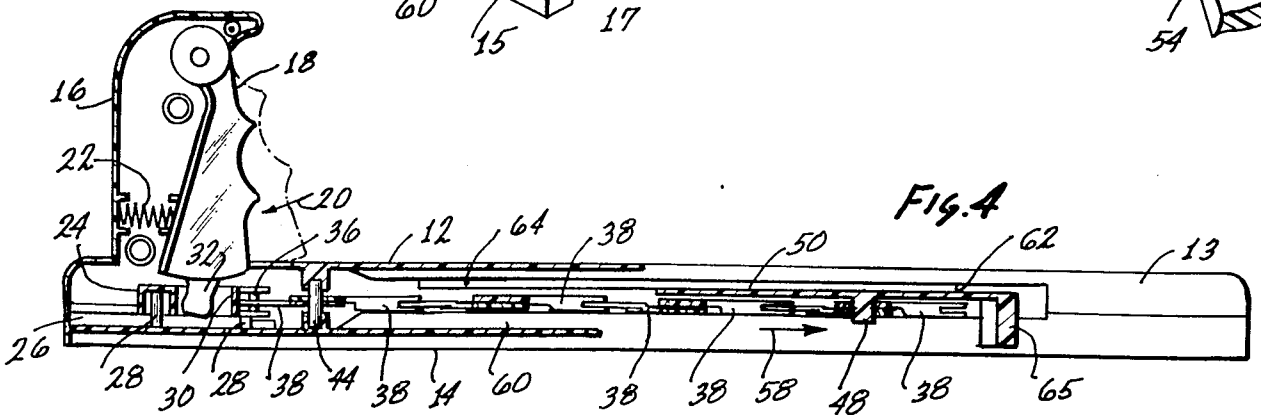
FIG. 4 is a longitudinal cross-sectional view of the launcher of FIG. 1.

Referring now to the drawings and particularly to FIGS. 1 and 4, a preferred embodiment of the toy car launcher 10 of the present invention is disclosed. The toy launcher 10 has top and bottom plate members 12 and 14, respectively, with a hand grip 16 connected to the top plate member 12 near one end of the launcher. Two elongated members 13 and 15 exist at the other end of the launcher 10 forming opening 17. The top and bottom plate members 12 and 14 may be held together by any suitable means such as pin and socket connectors, cement, or the like.

A trigger member 18 is pivotally connected to the hand grip 16 in order to allow member 18 to be moved in the direction of arrow 20 shown in FIG. 4. A spring 22 inside the hand grip 16 resists pivotal movememt of the trigger member 18.

Figure 2:
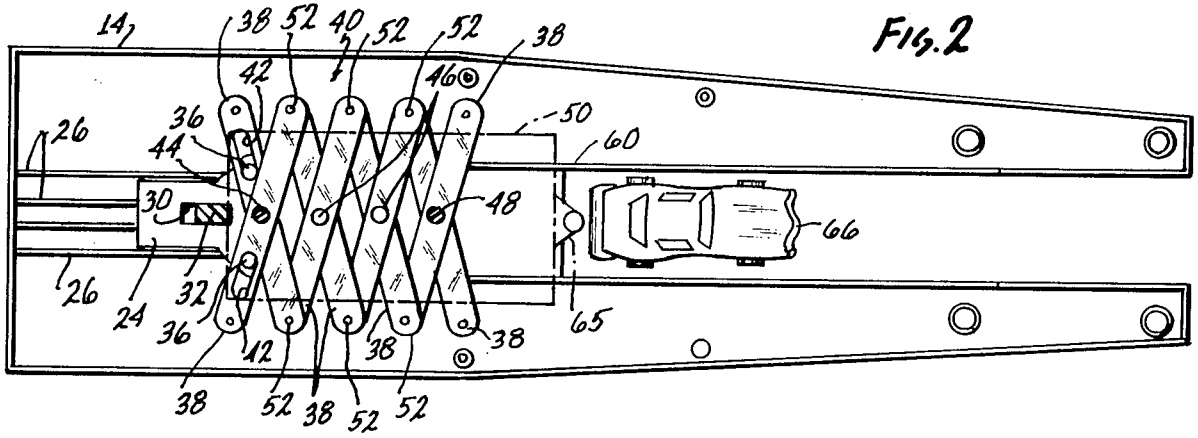
FIG. 2 is a top plan view of the launcher of FIG. 1 with a top plate member removed to show scissors members in an unexpanded position.
Figure 3:
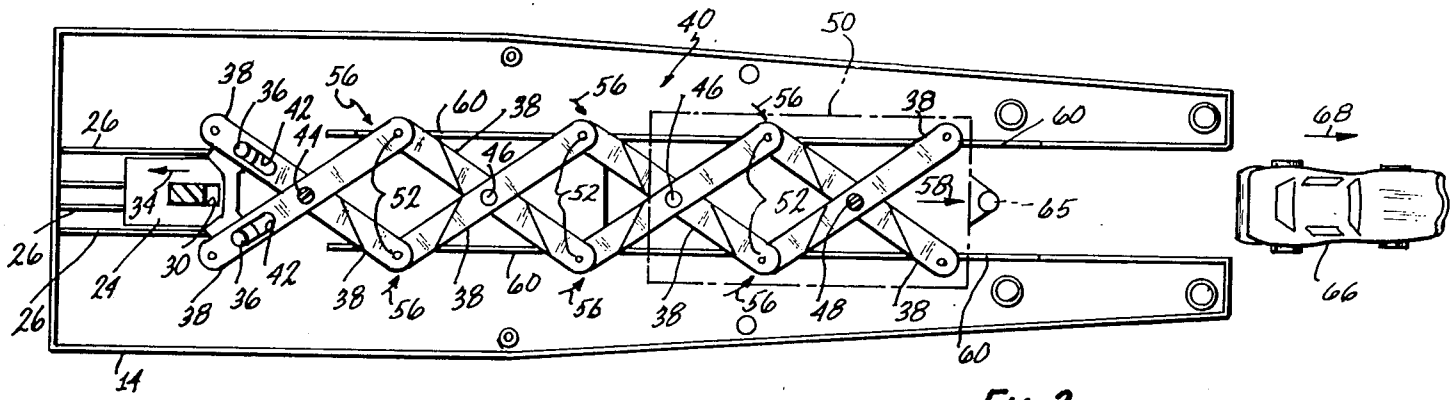
FIG. 3 is a view similar to that of FIG. 2 showing the scissors members in an expanded position.

FIGS. 2 through 4 show a sliding plate 24 which slidably engages ridges 26 attached to bottom plate member 14. The ridges 26 guide the plate 24 as it moves back and forth. Any means of slidably engaging the ridges 26 may be used such as pins 28 shown in FIG. 4. The sliding plate 24 has an aperture 30 therein. An extension 32 at the free end of the trigger member 18 engages aperture 30 as best shown in FIG. 4. As a result, the plate 24 is free to slide in the direction of arrow 34 shown in FIG. 3 when the trigger member 18 is moved in the direction of arrow 20.

Engaged to one end of the sliding plate 24 by pins 36 are two scissors members 38 which form part of an expandable parallelogram linkage 40. The pins 36 slidably engage elongated slots 42 passing through the scissors members 38 (see FIGS. 2 and 3). The two scissors members 38 engaging pins 36 are also rotatably engaged to pin 44 fixed to members 12 and 14 as shown in FIG. 4. Other suitable ways of mounting pin 44 in the launcher 10 may be used if desired. Other scissors members 38 complete the linkage 40. The members 38 are rotatably coupled to each other at midpoints 46 and to a pin 48 extending in a downward direction from a launching plate 50 (see FIG. 4). Pins 36, 44 and 48 pass through apertures in the members 38. In addition, the scissors members 38 have their ends rotatably engaged to each other at pivot points 52. Any suitable means may be used to couple the scissors members 38 to each other at points 46 and 52.

Figure 5:
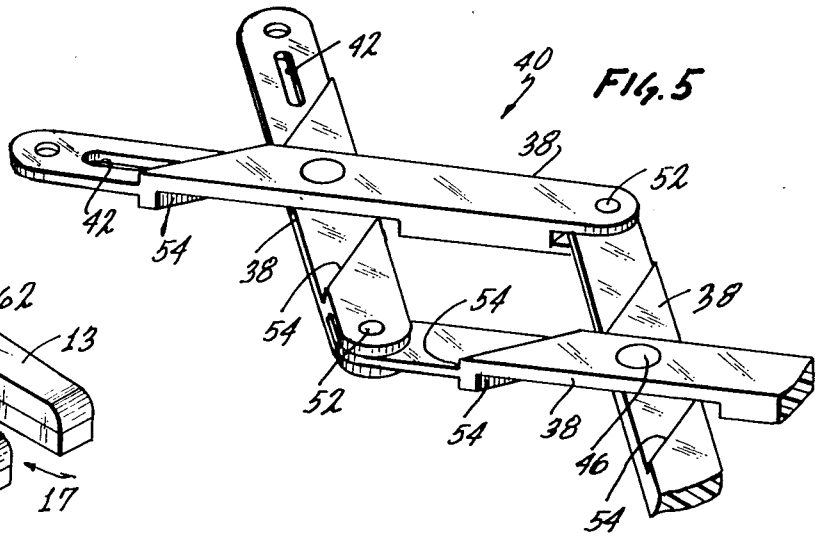
FIG. 5 is an enlarged detailed view of the scissors members.

FIG. 5 shows an enlarged view of some of the scissors members 38 used for the linkage 40. Note that the scissors members 38 preferably have recessed areas 54 to facilitate folding the members together while in an unexpanded position as shown in FIG. 2. Only eight scissors members 38 are shown in FIGS. 2 through 4. However, any desired number of members 38 may be used for the toy launcher 10.

When the hand grip 16 is squeezed and the trigger member 18 moves sliding plate 24 in the direction of arrow 34 (see FIG. 3), pins 36 will slide down slots 42 pulling the two scissors members 38 with slots 42 in the direction of arrow 34, causing these same two members to pivot about stationary pin 44. Pivotal movement about pin 44 causes pivot points 52 to move in the directions of arrows 56 and the linkage 40 to expand in the drection of arrow 58 as illustrated in FIG. 3.

As the linkage 40 expands, the launching plate 50 is pulled in the direction of arrow 58 as it rests on top of members 38 (see FIGS. 3 and 4). The scissors members 38 slide forward on top of two elongated ridges 60 attached to bottom plate member 14. The ridges 60 extend substantially along the length of member 14 as shown in FIGS. 2 through 4. The lower edges of elongated slots 62 (see FIG. 1) in members 13 and 15 define the top supporting edges of ridges 60. Guiding ridges 64 for the plate 50 are preferably attached to the top inside surface of the top plate member 12 as shown in FIG. 4. Ridges 64 help to guide plate 50 as it moves forward on top of the expandable linkage 40. A launching ram 65 is attached to the front end of the launching plate 50.

The toy launcher 10 may be used to launch a toy vehicle 66 as illustrated in FIGS. 2 and 3. If a child relaxes the hand grip 16, the spring 22 forces the trigger member 18 to the position represented by the dashed lines in FIG. 4. When the trigger member 18 is in this position, linkage 40 is disposed in an unexpanded position as shown in FIG. 2. The toy vehicle 66 may then be placed next to the launching ram 65. While in this position, the vehicle 66 would be positioned within opening 17 (see FIG. 1) and on top of the surface supporting the toy launcher 10. The child may then squeeze the hand grip 16, pulling the trigger member 18 in the direction of arrow 20 (see FIG. 4) which forces the linkage 40 to expand in the direction of arrow 58 and the launching ram 65 to propel the toy vehicle 66 forward along its path in the direction of arrow 68.

Since the linkage 40 expands in a relatively smooth and uniform manner in reaction to the hand grip being squeezed, the toy vehicle 66 is also launched in a relatively uniform manner. This feature of the launcher 10 helps to avoid activating or damaging any impact-activated mechanisms in the vehicle. In addition, a child may conrol the rate of acceleration of the vehicles being launched by controlling how hard the hand grip 16 is squeezed.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A toy vehicle launcher, comprising:

a hollow body portion;

a plurality of scissors members operably coupled together to form an expandable parallelogram linkage, said scissors members slidably mounted inside said body portion;

a launching plate supported by said scissors members;

a sliding plate operably engaged to said scissors members and slidably mounted inside said body portion; and hand grip means connected to said body portion for moving said sliding plate in order to activate said expandable parallelogram linkage.

2. The toy vehicle launcher of claim 1 wherein two of said scissors members are pivotally engaged to a pin mounted inside said body portion and have elongated slots therein operably engaged by pins attached to said sliding plate, two other of said scissors members pivotally engaging a pin attached to said launching plate, each one of the remaining number of said scissors members having each end thereof pivotally engaged to the end of another one of said scissors members and being pivotally engaged at the midpoint thereof to the midpoint of another one of said remaining scssors members.

3. The toy vehicle launcer of claim 1 wherein said body portion has ridges extending substantially along the length thereof adapted for supporting said scissors members and guiding ridges attached thereto adapted for guiding said launching plate.

4. The toy vehicle launcher of claim 3 wherein said body portion has an elongated opening formed by two elongated members extending therefrom, each of said elongated members having an elongated slot therein.

5. The toy vehicle launcher of claim 1 wherein said hand grip means includes a pivotally mounted trigger member and spring means for biasing said trigger member forward, said trigger member having an extension attached thereto engaging an aperture in said sliding plate.

6. A toy vehicle launcher, comprising:

a hollow body portion having an elongated opening formed by two elongated members extending therefrom, each of said elongated members having an elongated slot therein, said body portion having supporting ridges extending substantially along the length thereof and guiding ridges attached thereto;

a plurality of scissors members slidably mounted on said supporting ridges;

a launching plate having a launching ram and pin attached thereto, said launchig plate being supported by said scissors members and guided by said guiding ridges;

a sliding plate slidably mounted to ridges inside said body portion, two of said scissors members being pivotally engaged to a pin mounted inside said body portion and having elongated slots therein operably engaged by pins attached to said sliding plate, two other of said scissors members pivotally engaging said pin attached to said launching plate, each one of the remaining number of said scissors members having each end thereof pivotally engaged to the end of another one of said scissors members and being pivotally engaged at the midpoint thereof to the midpoint of another one of said remaining scissors members; and hand grip means connected to said body portion for moving said sliding plate in order to expand and contract said scissors members, said hand grip means including a pivotally mounted trigger member and spring means for biasing said trigger member forward, said trigger member having an extension attached thereto engaging an aperture in said sliding plate.

* * * * *